US010384413B2

(12) United States Patent
Hasegawa

(10) Patent No.: US 10,384,413 B2
(45) Date of Patent: Aug. 20, 2019

(54) SHEET PROCESSING SYSTEM, METHOD FOR CONTROLLING SHEET PROCESSING SYSTEM, AND STORAGE MEDIUM

(71) Applicant: CANON KABUSHIKI KAISHA, Tokyo (JP)

(72) Inventor: Teppei Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 613 days.

(21) Appl. No.: 14/639,837

(22) Filed: Mar. 5, 2015

(65) Prior Publication Data

US 2015/0251373 A1 Sep. 10, 2015

(30) Foreign Application Priority Data

Mar. 6, 2014 (JP) ..... 2014-044090

(51) Int. Cl.
*B31F 1/08* (2006.01)

(52) U.S. Cl.
CPC ..... *B31F 1/08* (2013.01); *G03G 2215/00877* (2013.01)

(58) Field of Classification Search
CPC ..... B65B 19/22; B65B 61/18; B65B 19/228; B65B 51/04; B65D 85/10; B65D 85/1045; B65D 2313/04; A24F 15/00; B65C 1/02
USPC ..... 493/395–399, 405
See application file for complete search history.

(56) References Cited

U.S. PATENT DOCUMENTS 1,941,484 A * 1/1934 Nasmith ..... B26D 3/085 493/396
3,039,372 A * 6/1962 La Bombard ..... B31F 1/08 493/396
3,955,019 A * 5/1976 Keith ..... B26F 1/24 264/248
3,963,813 A * 6/1976 Keith ..... B29C 51/24 264/165
4,614,632 A * 9/1986 Kezuka ..... B29C 51/08 264/280
5,509,885 A * 4/1996 Brunlid ..... B31F 1/08 493/160
6,162,155 A * 12/2000 Gordon ..... B31B 50/00 493/365

(Continued)

FOREIGN PATENT DOCUMENTS

JP 2011057363 A 3/2011
JP 2012-240843 A 12/2012

*Primary Examiner* — Hemant Desai
*Assistant Examiner* — Valentin Neacsu
(74) *Attorney, Agent, or Firm* — Canon U.S.A., Inc. IP Division

(57) ABSTRACT

A sheet processing system includes a creasing device, a binding device provided downstream of the creasing device in sheet conveying direction, and a controller. The creasing device performs creasing processing to crease a plurality of sheets. The binding device binds a sheet bundle to be folded. The sheet bundle to be folded includes the plurality of sheets creased by the creasing device. The controller controls the creasing device. In a case where a binding position of the sheet bundle is different from a creasing position of each sheet, the controller controls the creasing device to perform creasing processing such that the creasing position of an inner sheet of the sheet bundle to be folded is shifted toward the binding position with respect to the creasing position of an outer sheet of the sheet bundle to be folded.

4 Claims, 21 Drawing Sheets

(DOWNWARD DIRECTION, MOUNTAIN FOLD)

(DOWNWARD DIRECTON, MOUNTAIN FOLD)

(56) References Cited

U.S. PATENT DOCUMENTS

| | | | | |
|---|---|---|---|---|
| 7,429,171 | B2 * | 9/2008 | Akishev | B21D 13/02 425/388 |
| 7,488,169 | B2 * | 2/2009 | Keduka | B29C 51/24 264/299 |
| 8,083,661 | B2 * | 12/2011 | Garner | B31F 1/10 493/355 |
| 8,398,533 | B2 * | 3/2013 | Tsunoda | B65H 45/18 493/396 |
| 8,424,859 | B2 * | 4/2013 | Ishikawa | B31F 1/08 270/32 |
| 2008/0211159 | A1 * | 9/2008 | Iijima | B42B 4/00 270/37 |
| 2008/0252062 | A1 * | 10/2008 | Kelley | B65H 45/30 281/21.1 |
| 2009/0062096 | A1 * | 3/2009 | Sasahara | B31F 1/08 493/396 |
| 2012/0200873 | A1 * | 8/2012 | Mori | H04N 1/00196 358/1.12 |
| 2014/0129978 | A1 * | 5/2014 | Oishi | B42C 1/00 715/810 |
| 2014/0255127 | A1 * | 9/2014 | Yamaguchi | B31D 1/00 412/33 |

* cited by examiner

CONVENTIONAL PRODUCT (DOWNWARD DIRECTION)

CONVENTIONAL PRODUCT (DOWNWARD DIRECTION, MOUNTAIN FOLD)

(DOWNWARD DIRECTION, MOUNTAIN FOLD)

(UPWARD DIRECTION, MOUNTAIN FOLD)

(DOWNWARD DIRECTON, MOUNTAIN FOLD)

(UPWARD DIRECTION, MOUNTAIN FOLD)

CONVENTIONAL PRODUCT (UPWARD DIRECTION)

CONVENTIONAL PRODUCT (UPWARD DIRECTION, VALLEY FOLD)

(UPWARD DIRECTION, VALLEY FOLD)

(DOWNWARD DIRECTION, VALLEY FOLD)

(UPWARD DIRECTION, VALLEY FOLD)

(DOWNWARD DIRECTION, VALLEY FOLD)

FIG. 15

| PAPER NAME | GRAMMAGE | CREASING SHIFT AMOUNT |
|---|---|---|
| PLAIN PAPER | 85g/m$^2$ | 0.30mm |
| THIN PAPER | 60g/m$^2$ | 0.15mm |
| THICK PAPER | 150g/m$^2$ | 0.45mm |

SHEET PROCESSING SYSTEM, METHOD FOR CONTROLLING SHEET PROCESSING SYSTEM, AND STORAGE MEDIUM

BACKGROUND OF THE INVENTION

Field of the Invention

The present invention relates to a sheet processing system, a method for controlling the sheet processing system, and a storage medium.

Description of the Related Art

There has been widely used an image forming apparatus that performs print processing while being connected to a post-processing apparatus capable of performing post processing such as binding and folding. Performing a plurality of post-processing operations allows production of a wide variety of products.

There has been known a creasing apparatus as one of the post-processing apparatuses. The term "creasing" refers to processing for forming a crease on a sheet in the position where the sheet is to be folded. A convex creasing die and a concave creasing die are pressed together to hold the sheet therebetween, so that a crease is formed on the sheet in the position against which the dies are pressed. The creasing has the effect of preventing peeling-off of toner and cracking of the sheet when the sheet is folded.

Japanese Patent Application Laid-Open No. 2012-240843 discusses a technique in which when folding processing is to be performed on sheets after binding processing, a predetermined space is created between the non-bending portion of a binding needle and the sheets, so that the folding height of a folding portion can be decreased without causing the expansion of the folding portion due to the thickness of the sheets and the reduction of productivity.

A print product including a plurality of sheets may be subjected to the creasing processing and the binding processing. In this case, the binding position of the binding processing and the creasing position of the creasing processing may be the same or different from each other. If the binding position and the creasing position are different from each other and the creasing processing is performed on the plurality of sheets in the same creasing position, the distance from the binding position to the creasing position is the same on each of the sheets. As a result, when the product is folded in the creasing position, the sheets are distorted due to the thickness of the sheets or the folding position is displaced from the creasing position.

SUMMARY OF THE INVENTION

According to an aspect of the present invention, a sheet processing system includes a creasing unit configured to crease a plurality of sheets and a control unit configured to perform control to change, for each of the plurality of sheets, a position of a crease to be formed by the creasing unit.

Further features of the present invention will become apparent from the following description of exemplary embodiments with reference to the attached drawings.

BRIEF DESCRIPTION OF THE DRAWINGS

FIG. 15 is a table illustrating an example of a creasing shift amount for each type of paper.

DESCRIPTION OF THE EMBODIMENTS

Further features and aspects of the present invention will become apparent from the following detailed description of exemplary embodiments with reference to the attached drawings.

A first exemplary embodiment will be described below.

Figure 1:
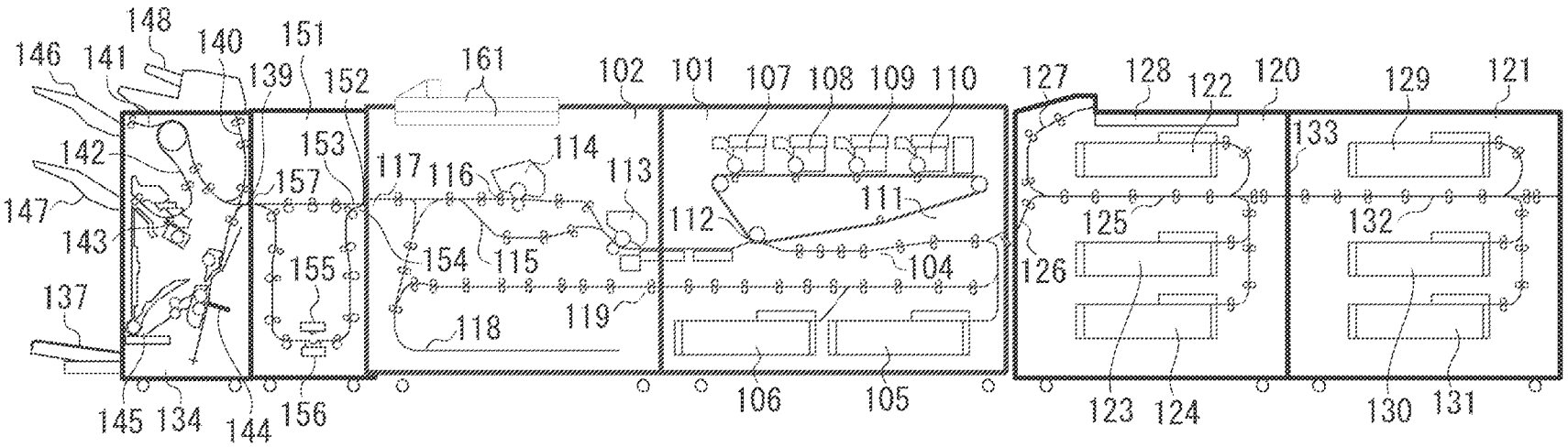
FIG. 1 is a schematic cross section illustrating an example of a configuration of an image forming apparatus according to an exemplary embodiment of the present invention.

FIG. 1 is a schematic cross section illustrating an example of a configuration of an image forming apparatus according to an exemplary embodiment of the present invention.

The configuration illustrated in FIG. 1 includes an image forming apparatus main body 101 and an image fixing apparatus 102.

A sheet feeding apparatus 120 is connected to the image forming apparatus main body 101. A plurality of sheet feeding apparatuses can be connected to the image forming apparatus main body 101. Another sheet feeding apparatus 121 is connected to the sheet feeding apparatus 120. A creasing apparatus 151 is connected to the image fixing apparatus 102 and performs creasing which is a characteristic feature of an exemplary embodiment of the present invention. Creasing a sheet such as paper allows the sheet to be easily folded later. Furthermore, a sheet discharge apparatus 134 is connected to the creasing apparatus 151.

The image forming apparatus main body 101 includes sheet feeding units 105 and 106. Developing units 107 to 110 are configured by stations of four colors, yellow (Y), magenta (M), cyan (C), and black (K) to form toner images of the respective colors. The images formed by these stations are primarily transferred onto an intermediate transfer belt 111 to form a color image, and the color image is rotated and transferred onto a sheet fed via a sheet conveyance path 104 at a secondary transfer position 112. The sheet to which the image is transferred is conveyed to the image fixing apparatus 102.

The sheet conveyed to the image fixing apparatus 102 (the sheet to which the image is transferred) is heated and pressed by a fixing unit 113 to fix the image to the sheet. The sheet that has passed through the fixing unit 113 is conveyed to the creasing apparatus 151 via sheet conveyance paths 115 and 117. Some type of paper is subjected to additional heating and pressing by a second fixing unit 114 and then conveyed to the creasing apparatus 151 via the sheet conveyance paths 116 and 117. When an image is to be printed on both sides of the sheet, the sheet is reversed by a sheet reversing path 118 and passes through sheet conveyance paths 119 and 104, so that printing is performed on the other side of the sheet.

A scanner unit 161 is connected to the image fixing apparatus 102. The scanner unit 161 uses a charge coupled device (CCD) image sensor to read an image of a sheet placed on a document positioning plate, and converts the image into image data. The image data is stored in a hard disk drive (HDD) 211 illustrated in FIG. 2 (described below).

A sheet can also be fed from the sheet feeding apparatuses 120 and 121. The sheet fed from any of sheet feeding units 122, 123, and 124 of the sheet feeding apparatus 120 is conveyed to the image forming apparatus main body 101 via sheet conveyance paths 125 and 126. The sheet fed from any of sheet feeding units 129, 130, and 131 of the sheet feeding apparatus 121 is conveyed to the image forming apparatus main body 101 via sheet conveyance paths 132, 133, 125, and 126. The sheet feeding apparatus 120 has a function of detecting a double-feed condition in which a plurality of sheets overlapping each other is fed. If the sheet feeding apparatus 120 detects the double-feed condition, printing is not performed on a sheet and the sheet conveyance path 126, which is normally used, is switched to a sheet conveyance path 127 to discharge the sheets to an escape tray 128.

The following describes the creasing apparatus 151.

The creasing apparatus 151 performs creasing on a sheet in a predetermined position. The sheet conveyed via sheet conveyance paths 152 and 154 is held between a convex creasing die 155 and a concave creasing die 156 to form a crease on the sheet. The creased sheet is conveyed to the sheet discharge apparatus 134 via a sheet conveyance path 157. If the creasing is not performed on the sheet, the sheet is conveyed to the sheet discharge apparatus 134 via sheet conveyance paths 152 and 153.

The following describes the sheet discharge apparatus 134.

The sheet discharge apparatus 134 has a function of performing post processing on a sheet subjected to printing and is capable of performing stapling, punching, and saddle stitch processing. The sheet discharge apparatus 134 includes sheet discharge units 146 and 147. The sheet that has passed through sheet conveyance paths 139 and 141 is discharged to the sheet discharge unit 146. The sheet that has passed through sheet conveyance paths 139 and 142 is discharged to the sheet discharge unit 147. The sheet passing through the sheet conveyance path 142 can be subjected to processing such as stapling or punching by a post processing unit 143. A sheet placed on a sheet insertion unit 148 passes through a sheet conveyance path 140, which allows the insertion of a sheet different from the sheet subjected to printing. A saddle stitch processing unit 144 staples the center of the sheet conveyed through the sheet conveyance path 139, folds the sheet in two, and discharges the sheet to a sheet discharge unit 137 via a sheet conveyance path 145.

Figure 2:
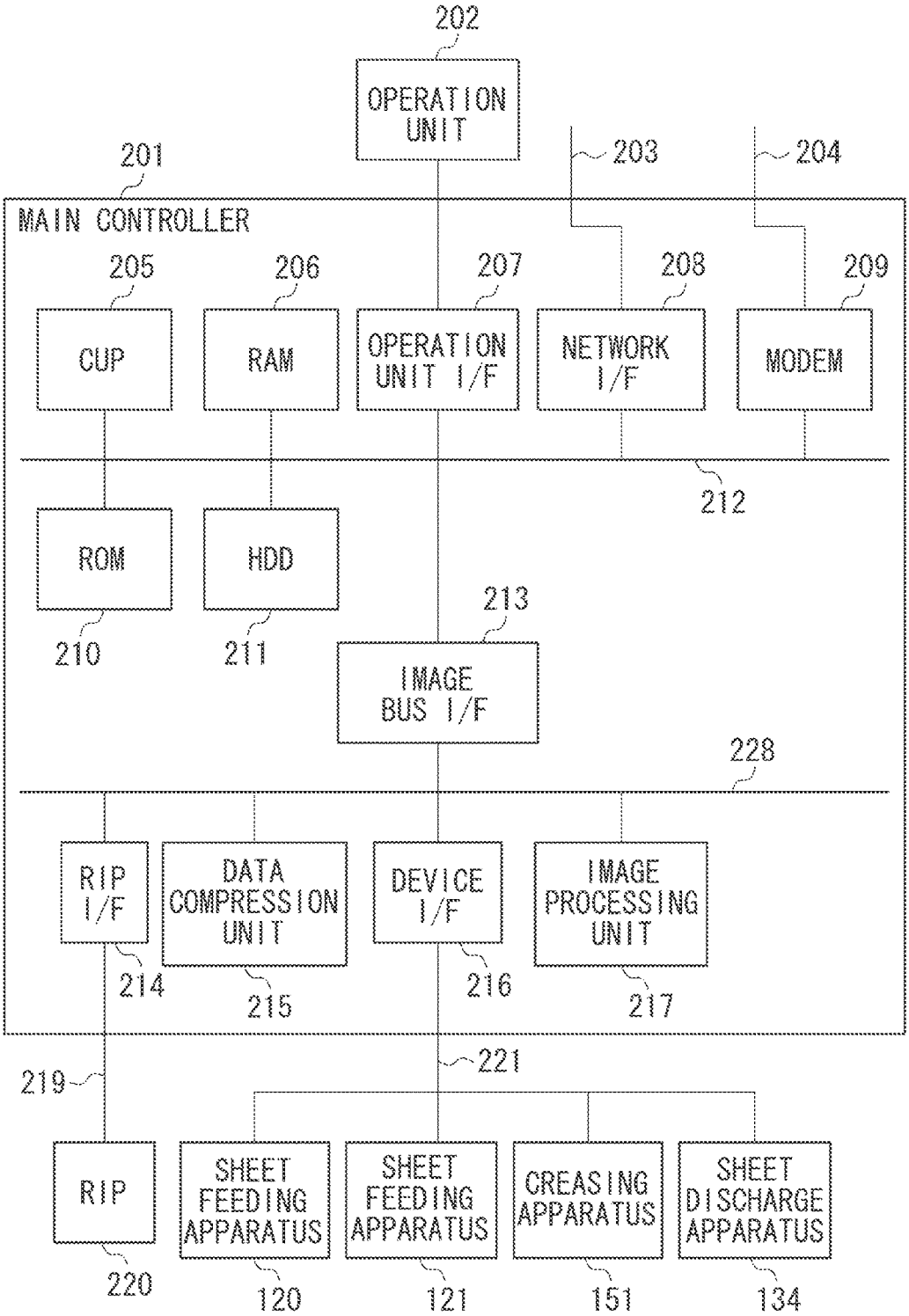
FIG. 2 is a block diagram illustrating an example of a control configuration of a main controller of a main body of the image forming apparatus.

FIG. 2 is a block diagram illustrating an example of a control configuration of a main controller 201 of the image forming apparatus main body 101.

The main controller 201 of the image forming apparatus main body 101 includes a central processing unit (CPU) 205, a random access memory (RAM) 206, an operation unit interface (I/F) 207, a network I/F 208, a modem 209, a read only memory (ROM) 210, and the HDD 211. The main controller 201 further includes a raster image processor (RIP) I/F 214, a data compression unit 215, a device I/F 216, and an image processing unit 217 via an image bus I/F 213. A CPU bus 212 and an image bus 228 are further included therein.

The sheet feeding apparatuses 120 and 121, the creasing apparatus 151, and the sheet discharge apparatus 134 are connected to the main controller 201 via a data bus 221, and the main controller 201 can control the operation of the apparatuses. FIG. 2 omits a printer engine of the image forming apparatus main body 101 and the image fixing apparatus 102. However, both of the printer engine and the image fixing apparatus 102 are connected to the main controller 201 via a predetermined interface and the main controller 201 can control the operation thereof.

The network I/F 208 is connected to a network cable 203 for connecting to an external apparatus via a network. The modem 209 is connected to a line cable 204 for connecting to an external apparatus via a telephone line.

The CPU 205 operates a program for controlling the entire part of the main controller 201. The RAM 206 is managed by a program that operates on the CPU 205. The RAM 206 is used as a receive buffer for temporarily storing data received from outside, or an image data buffer for temporarily storing image data rasterized by the RIP 220. The ROM 210 stores data and programs that operates on the CPU 205. The ROM 210 may be a rewritable type such as a flash ROM. The HDD 211 is a non-volatile storage device capable of storing various data for a long period of time and is a hard disk drive or a solid state drive, for example.

The operation unit I/F 207 is an interface for connecting an operation unit 202 and the main controller 201 to each other. The image bus I/F 213 is an interface for connecting the CPU bus 212 and the image bus 228 to each other. The RIP 220 is connected to the RIP I/F 214 via a data bus 219. The RIP 220 is a rasterizing board having a function of converting image description data input from outside into bitmapped image data. The RIP I/F 214 is an interface for connecting the RIP 220 and the image bus 228 to each other via the data bus 219. The data compression unit 215 compresses the image data.

the sheet feeding apparatuses 120 and 121, the creasing apparatus 151, and the sheet discharge apparatus 134 are connected to the device I/F 216 via the data bus 221. The CPU 205 issues a control command to the sheet feeding apparatuses 120 and 121, the creasing apparatus 151, and the sheet discharge apparatus 134 via the device I/F 216 and the data bus 221 according to an instruction signal input from the operation unit 202 or an external device via the network cable 203. The CPU 205 further issues a control command to the printer engine of the image forming apparatus main body 101 and the image fixing apparatus 102 via a predetermined interface according to an instruction signal input from the operation unit 202 or an external device via the network cable 203.

The image processing unit 217 performs various types of image processing on the bitmapped image data generated by the RIP 220. The image processing unit 217 has a function of digitally processing the bitmapped image data.

The following describes a case where both the creasing processing and the binding processing are performed.

Figure 3:
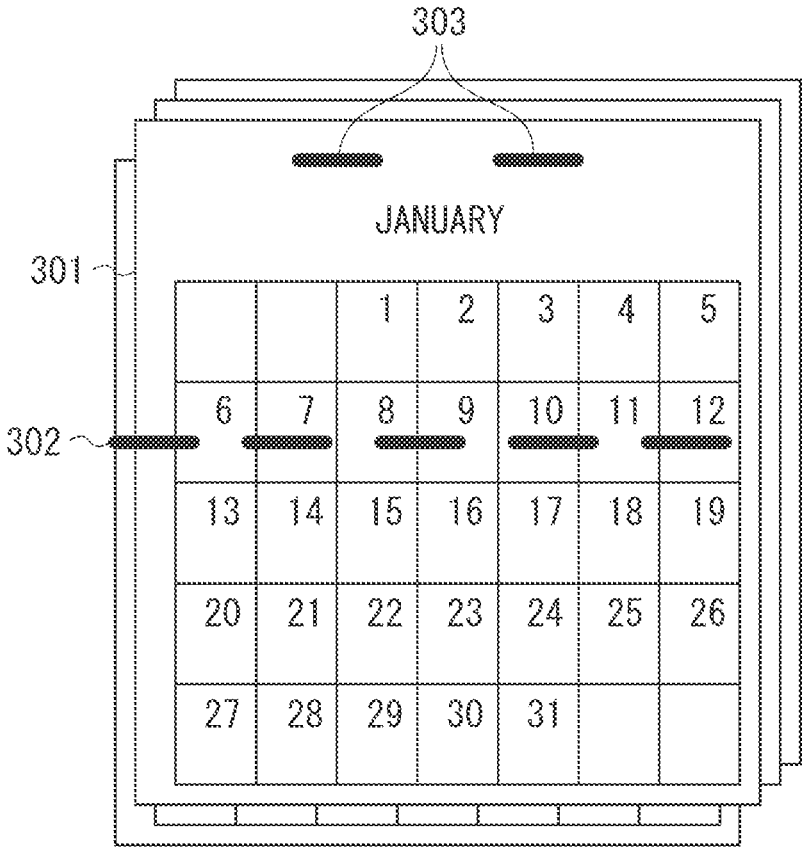
FIG. 3 illustrates an example of a product generated by creasing processing and binding processing.

FIG. 3 illustrates an example of a product generated by the creasing processing and the binding processing.

A product 301 illustrated in FIG. 3 is an example of the product generated by the creasing processing and the binding processing according to the present exemplary embodiment, such as a printed product like a calendar in which the end of a plurality of sheets is bound and which can be used with the sheets folded. A crease 302 is formed on the center portion of the product 301 by the creasing processing. A staple 303 is attached by the binding processing to the upper portion of the product 301.

Figure 4:
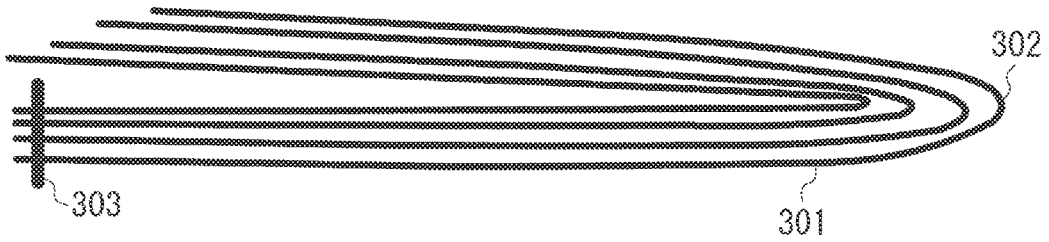
FIG. 4 illustrates a case where the product illustrated in FIG. 3 is folded along a crease.

FIG. 4 illustrates a case where the product 301 illustrated in FIG. 3 is folded along the crease 302.

The product 301 is normally used with the product 301 extended as illustrated in FIG. 3. However, the product 301 is subjected to the binding processing and the creasing processing so that the product 301 can be stored in a folded state as illustrated in FIG. 4.

Figure 5:
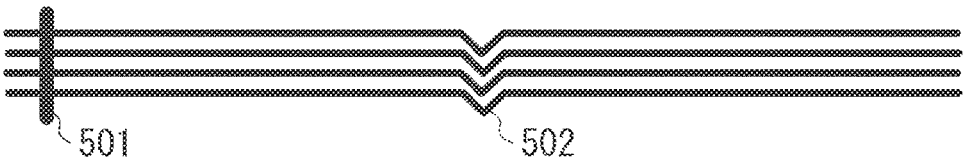
FIG. 5 illustrates a creasing position and a binding position of a conventional product (for a mountain fold).

FIG. 5 illustrates a creasing position and a binding position of a product generated by conventional processing having a problem to be solved.

As illustrated in FIG. 5, in the product generated by the conventional processing (hereinafter referred to as a conventional product), each of a binding position 501 and a creasing position 502 is the same on all sheets.

Figure 6:
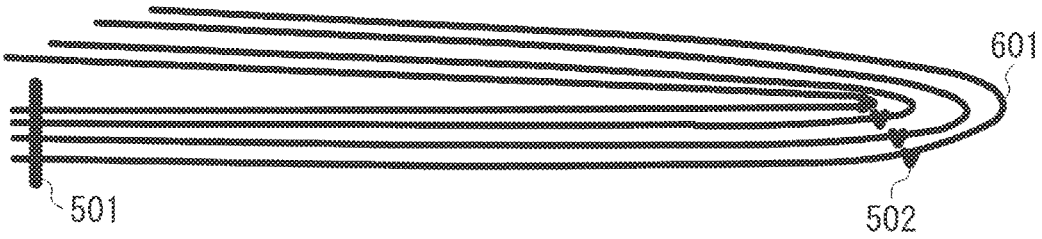
FIG. 6 illustrates a case where the product illustrated in FIG. 5 is folded at a folding position (with a mountain fold).

FIG. 6 illustrates a case where the conventional product illustrated in FIG. 5 is folded at a folding position 601.

As illustrated in FIG. 6, in the conventional product illustrated in FIG. 5, the distance between the binding position 501 and the creasing position 502 is the same on all sheets. As a result, when the product is folded, a sheet located on a more outer side causes the folding position 601 to be displaced further from the creasing position 502. Thus, the conventional product cannot be folded at the creasing position 502. If the conventional product is forcibly folded at the creasing position 502, the product may be distorted or the binding portion thereof may be damaged.

Figure 7A:
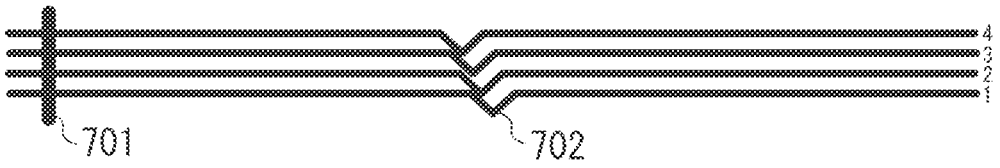
FIGS. 7A and 7B each illustrate a creasing position and a binding position of a product according to a first exemplary embodiment (for a mountain fold).
Figure 7B:
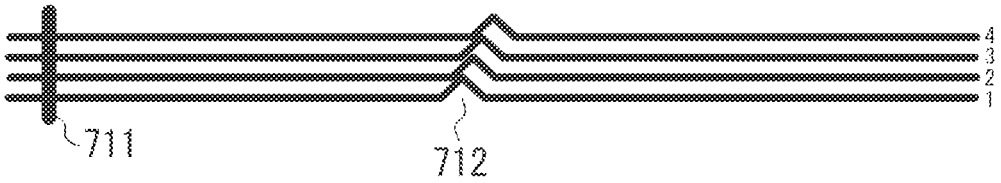
Figure 8A:
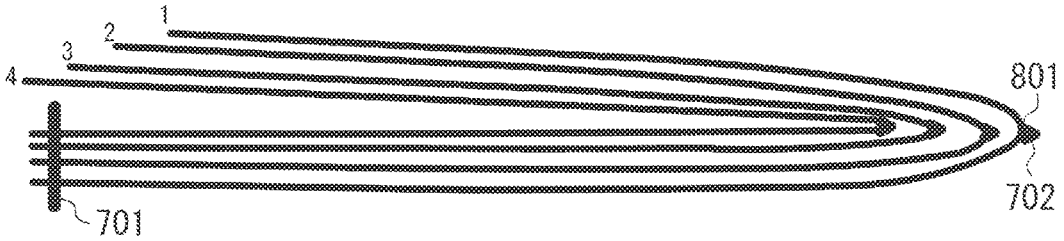
FIGS. 8A and 8B illustrate the products illustrated in FIGS. 7A and 7B, which are folded in folding positions, respectively (with a mountain fold).
Figure 8B:
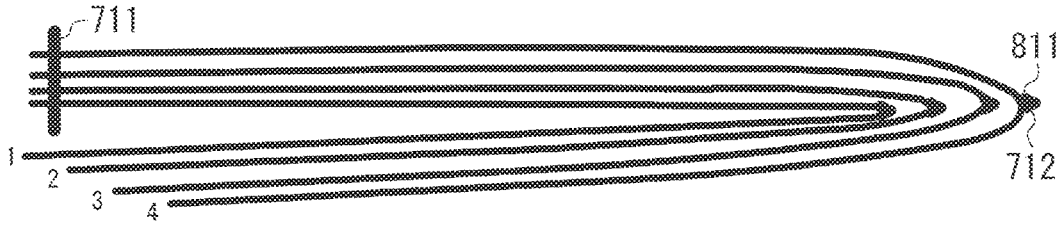

FIGS. 7A and 7B each illustrate a creasing position and a binding position of a product generated by processing according to the present exemplary embodiment. FIGS. 8A and 8B illustrate the products according to the present exemplary embodiment illustrated in FIGS. 7A and 7B, which are folded at folding positions 801 and 811, respectively.

As illustrated in FIG. 7A, in the product generated by the processing according to the present exemplary embodiment (hereinafter referred to as the product according to the present exemplary embodiment), a binding position 701 is the same on all sheets. On the other hand, a creasing position 702 is shifted little by little so that the creasing position 702 is shifted further on a sheet which is to be located on a more outer side when the product is folded.

As illustrated in FIG. 8A, in the product according to the present exemplary embodiment illustrated in FIG. 7A, the creasing position 702 is shifted for each sheet and therefore the product can be folded in such a way that the folding position 801 matches the creasing position 702. Thus, the product according to the present exemplary embodiment can be naturally and finely folded at the creasing position 702.

FIGS. 7A and 8A correspond to a case where the product is folded so that a crease looks like a mountain in the creasing (downward) direction ("downward direction, mountain fold"). Hereinafter, by referring to FIGS. 7B and 8B, a case will be described in which the product is folded so that a crease looks like a mountain in the creasing (upward) direction ("upward direction, mountain fold").

This is also similar to the above-described case. As illustrated in FIG. 7B, in the product according to the present exemplary embodiment, a binding position 711 is the same on all sheets. On the other hand, a creasing position 712 is shifted little by little so that the creasing position 712 is shifted further on a sheet which is to be located on a more outer side when the product is folded.

As illustrated in FIG. 8B, similarly to the above-described case, in the product according to the present exemplary embodiment illustrated in FIG. 7B, the creasing position 712 is shifted for each sheet and therefore the product can be folded so that the folding position 811 matches the creasing position 712. Thus, the product according to the present exemplary embodiment can be naturally and finely folded at the creasing position 712.

By referring to FIGS. 5, 6, 7A and 7B, and 8A and 8B, the case has been described in which the product is folded so that a crease looks like a mountain (hereinafter referred to as "mountain fold") after the creasing processing. On the other hand, there is another case where the product is folded so that a crease looks like a valley (hereinafter referred to as "valley fold") after the creasing processing.

Both the mountain fold and the valley fold can be expected to be effective for preventing peeling-off of toner and cracking of a sheet from occurring when the sheet is folded. Normally, a determination as to whether the mountain fold or the valley fold is used is made in consideration of the type of paper to be used or the appearance of a folding position.

The following describes a case where the valley fold is made at the creasing position, with reference to FIGS. 9, 10, 11A, 11B, 12A, and 12B.

Figure 9:
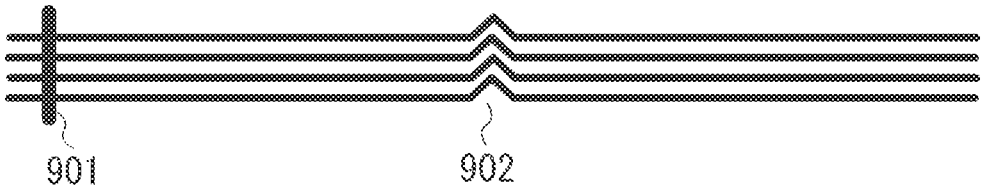
FIG. 9 illustrates a creasing position and a binding position of a conventional product (for a valley fold).

FIG. 9 illustrates a creasing position and a binding position of the conventional product having a problem to be solved.

As illustrated in FIG. 9, in the conventional product, each of a binding position 901 and a creasing position 902 is the same on all sheets.

Figure 10:
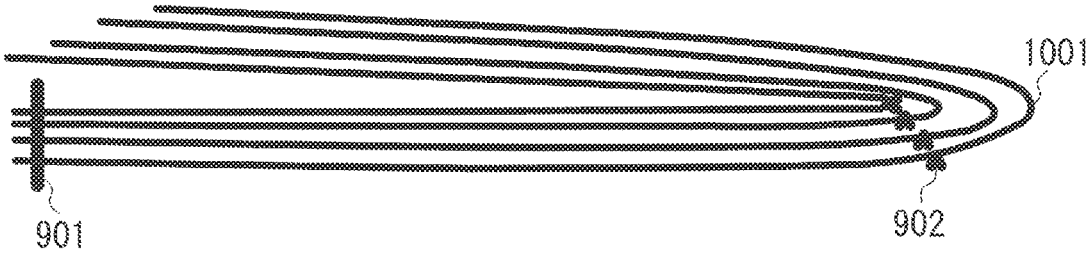
FIG. 10 illustrates a case where the product illustrated in FIG. 9 is folded at a folding position (with a valley fold).

FIG. 10 illustrates a case where the conventional product illustrated in FIG. 9 is folded at a folding position 1001.

As illustrated in FIG. 10, in the conventional product illustrated in FIG. 9, the distance between the binding position 901 and the creasing position 902 is the same on all sheets. As a result, when the product is folded, a sheet located on a more outer side causes the folding position 1001 to be displaced further from the creasing position 902. Thus, the conventional product cannot be folded at the creasing position 902. If the conventional product is forcibly folded at the creasing position 902, the product may be distorted or the binding portion thereof may be damaged.

Figure 11A:
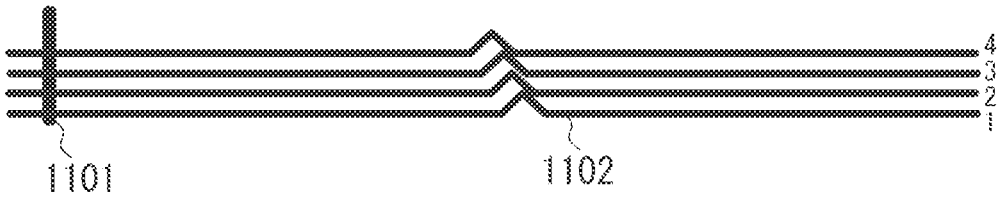
FIGS. 11A and 11B each illustrate a creasing position and a binding position of the product according to the first exemplary embodiment (for a valley fold).
Figure 11B:
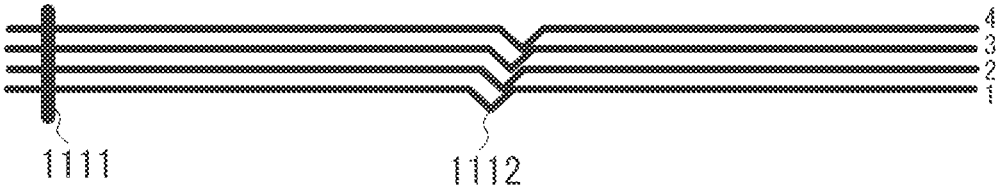

FIGS. 11A and 11B each illustrate a creasing position and a binding position of the product according to the present exemplary embodiment.

Figure 12A:
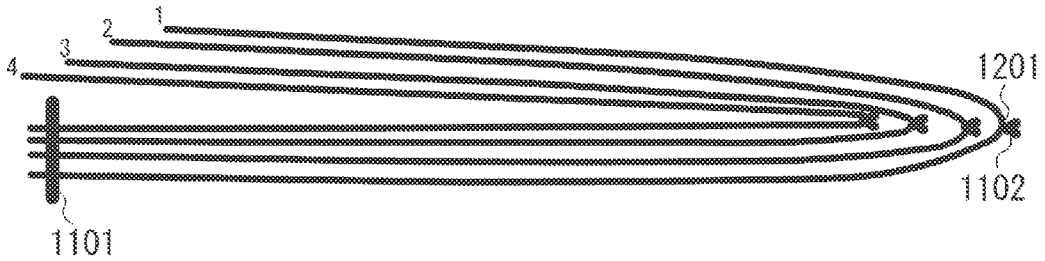
FIGS. 12A and 12B illustrate the products illustrated in FIGS. 11A and 11B, which are folded in folding positions, respectively (with a valley fold).
Figure 12B:
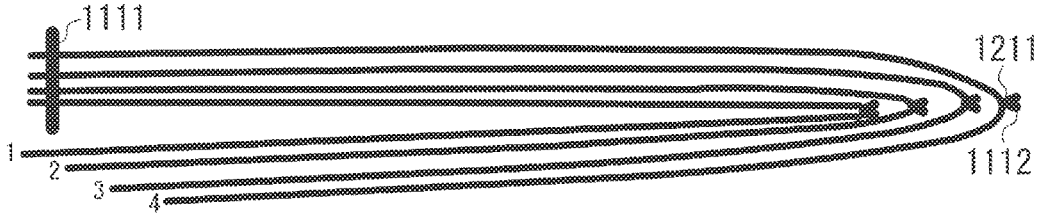

FIGS. 12A and 12B illustrate the products according to the present exemplary embodiment illustrated in FIGS. 11A and 11B, which are folded at folding positions 1201 and 1211, respectively.

As illustrated in FIG. 11A, in the product according to the present exemplary embodiment, a binding position 1101 is the same on all sheets. On the other hand, a creasing position 1102 is shifted little by little so that the creasing position 1102 is shifted further on a sheet which is to be located on a more outer side when the product is folded.

As illustrated in FIG. 12A, in the product according to the present exemplary embodiment illustrated in FIG. 11A, the creasing position 1102 is shifted for each sheet and therefore the product can be folded so that the folding position 1201 matches the creasing position 1102. Thus, the product according to the present exemplary embodiment can be naturally and finely folded at the creasing position 1102.

FIG. 11A and FIG. 12A correspond to a case where the product is folded so that a crease looks like a valley in the creasing (upward) direction ("upward direction, valley fold"). Hereinafter, by referring to FIGS. 11B and 12B, a case will be described where the product is folded so that a crease looks like a valley in the creasing (downward) direction ("downward direction, valley fold").

This is similar to the above-described case. As illustrated in FIG. 11B, similarly to the above-described case, in the product according to the present exemplary embodiment, a binding position 1111 is the same on all sheets. On the other hand, a creasing position 1112 is shifted little by little so that the creasing position 1112 is shifted further on a sheet which is to be located on a more outer side when the product is folded.

As illustrated in FIG. 12B, similarly to the above-described case, in the product according to the present exemplary embodiment illustrated in FIG. 11B, the creasing position 1112 is shifted for each sheet and therefore the product can be folded so that the folding position 1211 matches the creasing position 1112. Thus, the product according to the present exemplary embodiment can be naturally and finely folded at the creasing position 1112.

A flow of the processing by the image forming apparatus main body 101 according to the first exemplary embodiment will be described below with reference to FIG. 13.

Figures 13, 13A:
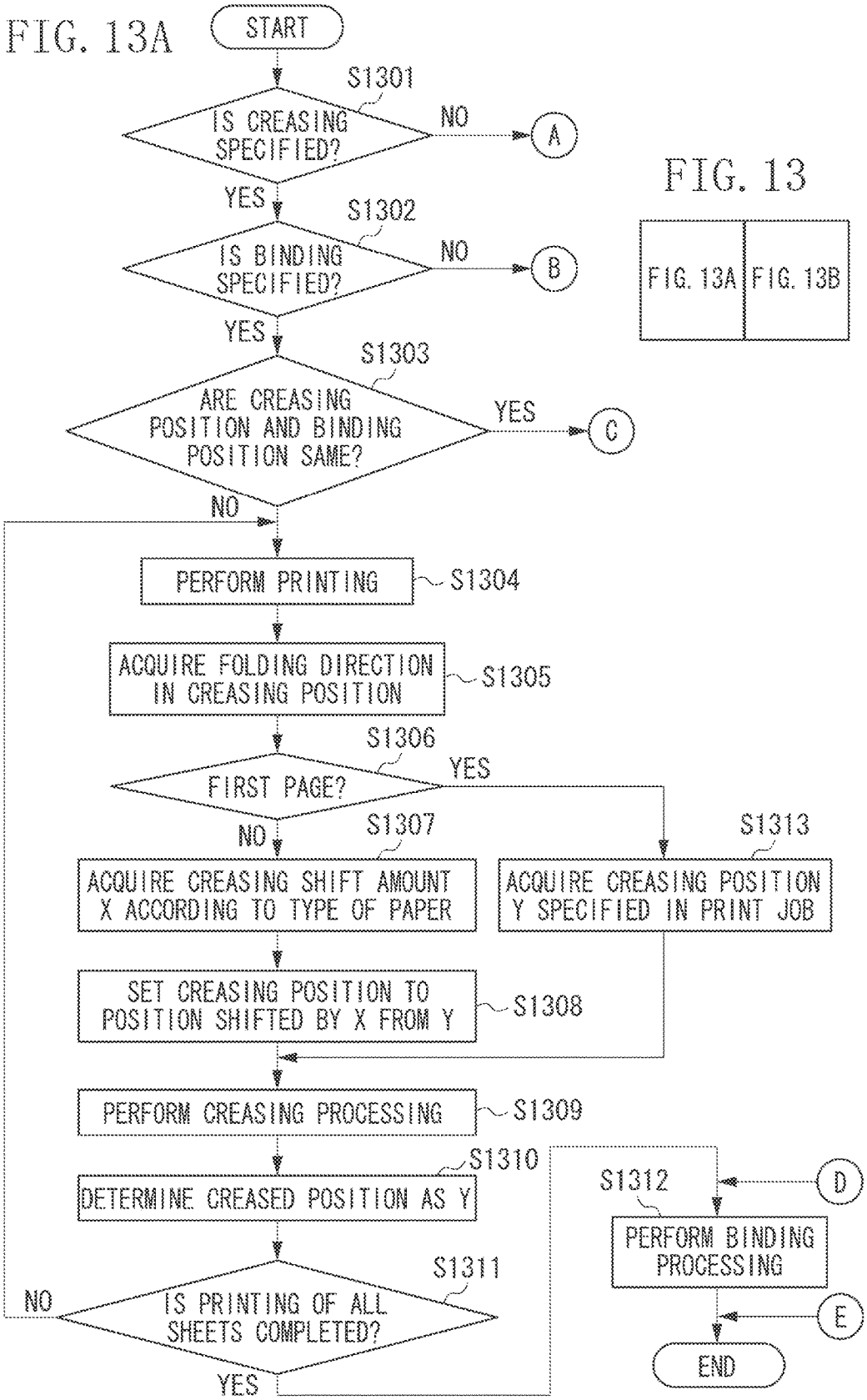
FIG. 13, which consists of FIG. 13A and FIG. 13B, is a flowchart illustrating an example of processing by the image forming apparatus main body according to the first exemplary embodiment.
Figure 13B:
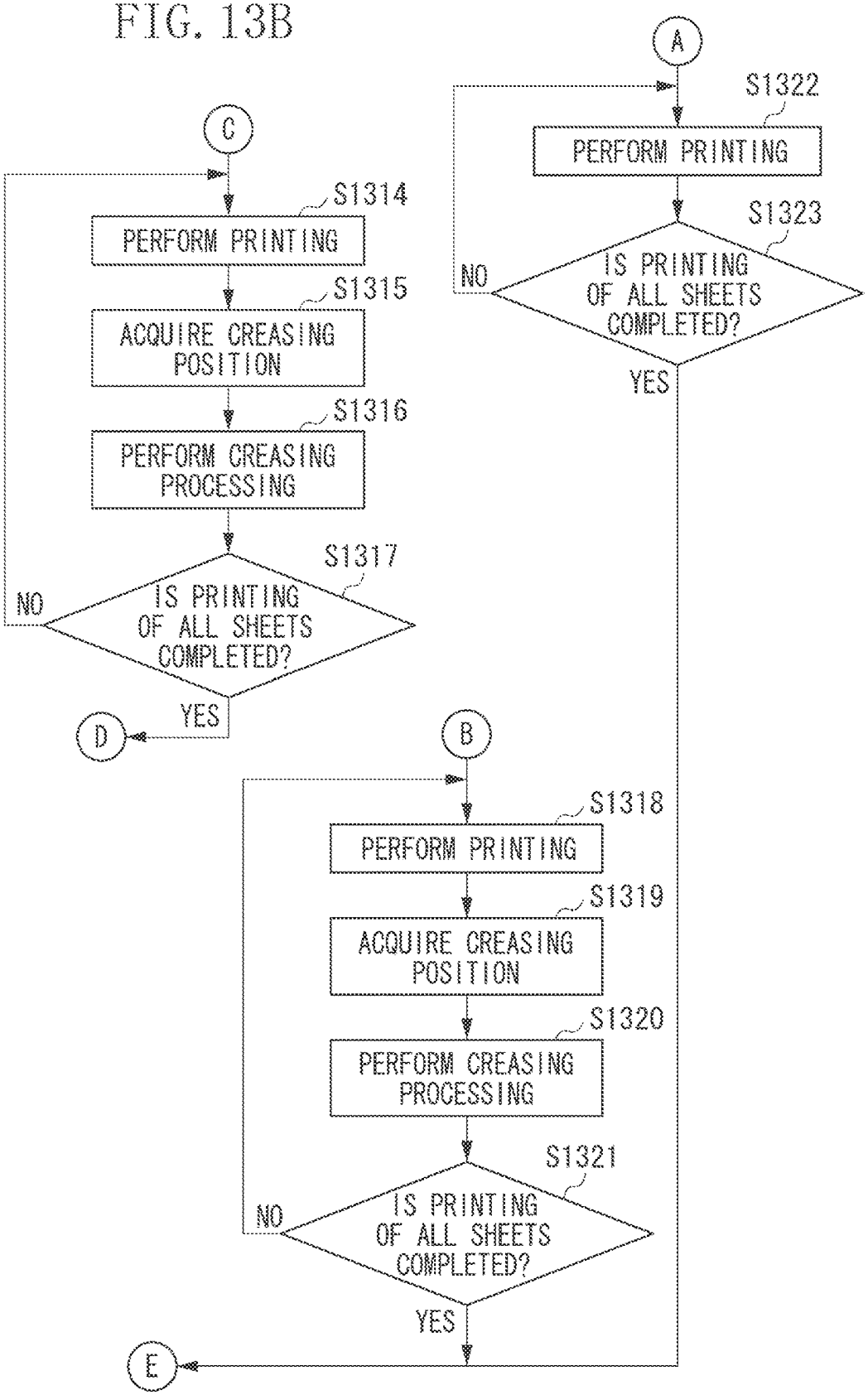

FIG. 13 is a flowchart illustrating an example of the processing by the image forming apparatus main body 101 according to the first exemplary embodiment. The processing of the flowchart is realized by the CPU 205 of the main controller 201 of the image forming apparatus main body 101 executing a program stored, for example, in the ROM 210.

The CPU 205 starts the processing of the flowchart at the time of starting the execution of a print job. In step S1301, the CPU 205 determines whether creasing is specified in the print job. The creasing may be specified in the print job, or a setting value for specifying the creasing may be stored in the ROM 210 or the HDD 211 of the image forming apparatus main body 101. If the CPU 205 determines that the creasing is not specified (NO in step S1301), the processing proceeds to step S1322.

In step S1322, the CPU 205 controls the image forming apparatus main body 101 and the image fixing apparatus 102 to perform print processing for the print job. In step S1323, the CPU 205 determines whether the printing has been completed on all sheets for the print job. If the CPU 205 determines that the printing has not been completed on all sheets (NO in step S1323), the processing proceeds to step S1322. If the CPU 205 determines that the printing has been completed on all sheets (YES in step S1323), the processing ends.

In step S1301, if the CPU 205 determines that the creasing is specified in the print job (YES in step S1301), the processing proceeds to step S1302. In step S1302, the CPU 205 determines whether binding is specified in the print job. The binding may be specified in the print job, or a setting value for specifying the binding may be stored in the ROM 210 or the HDD 211 of the image forming apparatus main body 101. If the CPU 205 determines that the binding is not specified (NO in step S1302), the processing proceeds to step S1318.

In step S1318, the CPU 205 controls the image forming apparatus main body 101 and the image fixing apparatus 102 to perform print processing for the print job. In step S1319, the CPU 205 acquires a creasing position specified in the print job. The creasing position may be specified in the print job, or a value for setting the creasing position may be stored in the ROM 210 or the HDD 211 of the image forming apparatus main body 101.

In step S1320, the CPU 205 controls the creasing apparatus 151 to perform creasing processing on the sheet subjected to printing in step S1318, at the creasing position acquired in step S1319. In step S1321, the CPU 205 determines whether the printing has been completed on all sheets for the print job. If the CPU 205 determines that the printing has not been completed on all sheets (NO in step S1321), the processing proceeds to step S1318. If the CPU 205 determines that the printing has been completed on all sheets (YES in step S1321), the processing ends.

In step S1302, if the CPU 205 determines that the binding is specified in the print job (YES in step S1302), the processing proceeds to step S1303. In step S1303, the CPU 205 determines whether the creasing position specified in the print job and a binding position specified in the print job are the same. The binding position may be specified in the print job, or a value for setting the binding position may be stored in the ROM 210 or the HDD 211 of the image forming apparatus main body 101. The processing in which the creasing position and the binding position are the same is saddle stitching, for example, in which the folding processing and the binding processing are performed at the creasing position.

In step S1303, if the CPU 205 determines that the creasing position and the binding position are the same (YES in step S1303), the processing proceeds to step S1314. In step S1314, the CPU 205 controls the image forming apparatus main body 101 and the image fixing apparatus 102 to perform print processing for the print job. In step S1315, the CPU 205 acquires the creasing position specified in the print job. In step S1316, the CPU 205 controls the creasing apparatus 151 to perform creasing processing on the sheet subjected to printing in step S1314, at the creasing position acquired in step S1315. In step S1317, the CPU 205 determines whether the printing has been completed on all sheets for the print job. If the CPU 205 determines that the printing has not been completed on all sheets (NO in step S1317), the processing proceeds to step S1314. If the CPU 205 determines that the printing has been completed on all sheets (YES in step S1317), the processing proceeds to step S1312. In step S1312, the CPU 205 controls the sheet discharge apparatus 134 to perform binding processing on the bundle of sheets on which the printing has been completed, and the processing ends.

In step S1303, if the CPU 205 determines that the creasing position and the binding position are not the same (NO in step S1303), the processing proceeds to step S1304. In step S1304, the CPU 205 controls the image forming apparatus main body 101 and the image fixing apparatus 102 to perform print processing for the print job.

In step S1305, the CPU 205 acquires a folding direction at the creasing position, which is specified in the print job. Acquiring the folding direction at the creasing position allows determining which sheet is to be located inside, thereby determining the direction in which the creasing position is to be shifted in step S1308 (described below). The folding direction at the creasing position is determined by a combination of the creasing direction (upward/downward) and the folding method (mountain fold/valley fold). Hereinafter, a description will be made with reference to FIG. 14.

Figure 14:
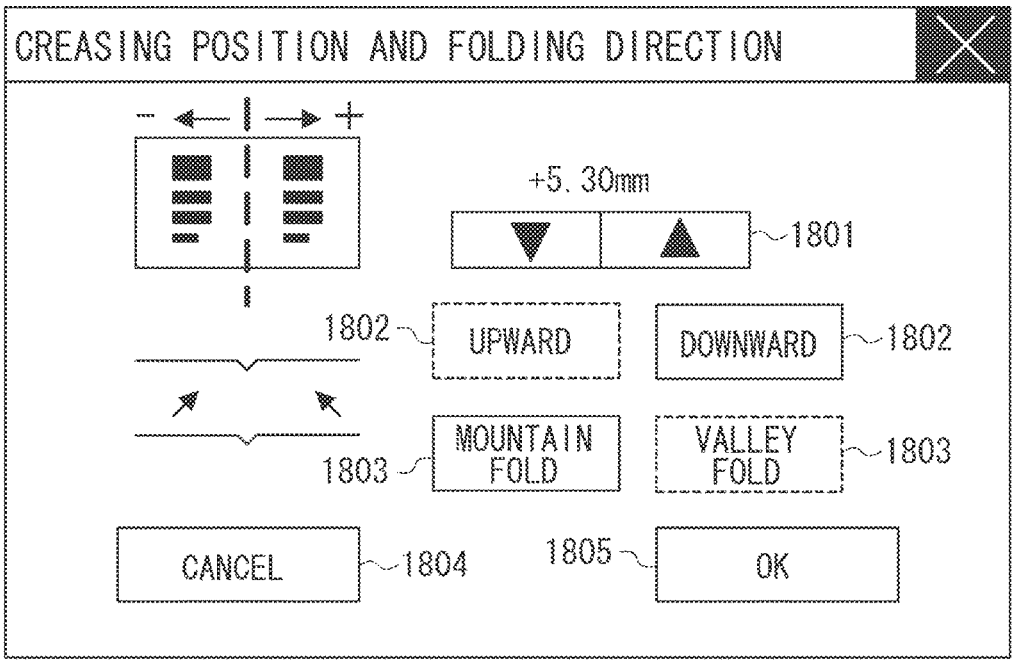
FIG. 14 illustrates an example of a screen for setting a creasing position and a folding direction.

FIG. 14 illustrates an example of a screen for setting a creasing position and a folding direction.

A creasing position on a sheet is adjusted by using a creasing position adjusting button 1801. A creasing direction is specified by using a creasing direction specifying button 1802. A folding method is specified by using a folding method specifying button 1803. The folding direction at the creasing position is specified by a combination of the creasing direction specified by using the creasing direction specifying button 1802 and the folding method specified by using the folding method specifying button 1803. Pressing an "OK" button 1805 completes the setting of the creasing position and the folding direction. On the other hand, pressing a "cancel" button 1804 cancels the setting of the creasing position and the folding direction.

If the print job is a job that issues an instruction of execution from the operation unit 202, such as a scan job or a box print job, the screen illustrated in FIG. 14 is displayed on the operation unit 202. The box print job is, for example, a job that specifies print data stored in the HDD 211 of the image forming apparatus main body 101 via the operation unit 202 and then prints the print data. If the print job is a job that issues an instruction of execution from a personal computer (PC), the screen illustrated in FIG. 14 is displayed on a screen provided by a printer driver of the PC. The creasing position and the folding direction set via the screen illustrated in FIG. 14 may be specified in the print job, or a setting value thereof may be stored in the ROM 210 or the HDD 211 of the image forming apparatus main body 101.

The following describes a combination of the creasing direction and the folding method, and a relationship between the creasing position and the folding direction. In the case of "downward direction" and "mountain fold," as illustrated in FIGS. 7A and 8A, sheets are folded in a direction that causes the first page to be located on the outermost side (causes the last page to be located on the innermost side), which is referred to as a "first folding direction." Also, in the case of "upward direction" and "valley fold," as illustrated in FIGS. 11A and 12A, sheets are folded in the first folding direction. In the case of the first folding direction, each of the creasing positions on the second and subsequent pages needs to be shifted to be closer to the binding side than the creasing position on the preceding paper.

In the case of "upward direction" and "mountain fold," as illustrated in FIGS. 7B and 8B, sheets are folded in a direction that causes the first page to be located on the innermost side, which is referred to as a "second folding direction." Also, in the case of "downward direction" and "valley fold", sheets are folded in the second folding direction, as illustrated in FIGS. 11B and 12B. In the case of the second folding direction, each of the creasing positions on the second and subsequent pages needs to be shifted to be closer to a side opposite to the binding side than the creasing position on the preceding sheet.

In step S1305 illustrated in FIG. 13, the CPU 205 acquires the folding direction at the creasing position from the specified combination of the creasing direction and the folding method.

Next, in step S1306, the CPU 205 determines whether the sheet subjected to printing in step S1304 is the first page. If the CPU 205 determines that the sheet is the first page (YES in step S1306), the processing proceeds to step S1313. In step S1313, the CPU 205 acquires the creasing position specified in the print job.

In step S1309, following step S1313, the CPU 205 controls the creasing apparatus 151 to perform creasing processing on the sheet subjected to printing in step S1304, at the creasing position acquired in step S1313.

In step S1310, the CPU 205 determines the creased position in step S1309 as Y and stores the position in the RAM 206, the ROM 210 (in the case of a flash ROM), or the HDD 211, and the processing proceeds to step S1311. In step S1311, the CPU 205 determines whether the printing has been completed on all sheets to be subjected to printing for the print job. If the CPU 205 determines that the printing has not been completed on all sheets (NO in step S1311), the processing proceeds to step S1304.

In step S1306, if the CPU 205 determines that the sheet subjected to printing in step S1304 is not the first page (NO in step S1306), the processing proceeds to step S1307. In step S1307, the CPU 205 acquires a creasing shift amount X according to the type of paper. The following describes the creasing shift amount X according to the type of paper with reference to FIG. 15.

FIG. 15 is a table illustrating an example of the creasing shift amount X for each type of paper.

As illustrated in FIG. 15, in the present exemplary embodiment, the creasing shift amount X is set depending on the paper name and the type of paper determined by grammage. The grammage indicates the weight per unit area of paper. The creasing shift amount X for each type of paper is greater than the thickness of paper. Alternatively, the creasing shift amount X may be set depending on the type of paper determined by the thickness of paper, instead of the grammage. The table illustrated in FIG. 15 is assumed to have been previously stored in the ROM 210 or the HDD 211 of the image forming apparatus main body 101 (for example by a manager setting the table before shipment from a factory). In step S1307 illustrated in FIG. 13, the table illustrated in FIG. 15 is assumed to be read from the ROM 210 or the HDD 211 to acquire the creasing shift amount X according to the type of paper.

FIG. 15 illustrates a configuration for determining the creasing shift amount X according to the type of paper. Because the degree of distortion (folding angle) of sheets in folding the sheets changes depending on the number of sheets included in a product, the creasing shift amount X may also be changed depending on the number of sheets included in the product. This allows the creasing shift amount X to be specified more accurately.

In step S1308, the CPU 205 sets the creasing position to the position shifted by the creasing shift amount X from the position Y acquired in step S1310. Herein, the shifting direction is a direction that shifts the creasing position to a side opposite to the binding side by a smaller amount on a sheet which is to be located on a more inner side and by a larger amount on a sheet which is to be located on a more outer side, based on the folding direction (the first folding direction/the second folding direction) at the creasing position acquired in step S1305. That is, the creasing processing is performed in such a way that the creasing position is shifted in a direction opposite to the binding side by a smaller amount on a sheet which is to be located on a more inner side and by a larger amount on a sheet which is to be located on a more outer side when sheets are folded along the creases formed by the creasing processing. In the present exemplary embodiment, control is performed to set the specified creasing position (the position acquired in step S1313) on the first page. In the case of the first folding direction, since the first page is to be located on the outermost side (the last page is to be located on the innermost side), each of the creasing positions on the second and subsequent pages is controlled to be shifted to be closer to the binding side than the creasing position on the preceding page. On the other hand, in the case of the second folding direction, since the first page is to be located on the innermost side, each of the creasing positions on the second and subsequent pages is controlled to be shifted to be closer to a side opposite to the binding side than the creasing position on the preceding page. The above-described case is that the creasing position on the first page is the specified creasing position (the position acquired in step S1313). Alternatively, the creasing position on the sheet to be located on the outermost side or on the innermost side, for example, may be controlled to be the specified creasing position (the position acquired in step S1313).

Following step S1308, in step S1309, the CPU 205 controls the creasing apparatus 151 to perform creasing processing on the sheet subjected to printing in step S1304, at the creasing position determined in step S1309.

In step S1310, the CPU 205 determines the creased position in step S1309 as Y and stores the position in the RAM 206, the ROM 210 (in the case of a flash ROM), or the HDD 211, and the processing proceeds to step S1311. In step S1311, the CPU 205 determines whether the printing has been completed on all sheets to be subjected to printing for the print job. If the CPU 205 determines that the printing has not been completed on all sheets (NO in step S1311), the processing proceeds to step S1304.

In step S1311, if the CPU 205 determines that the printing has been completed on all sheets (YES in step S1311), the processing proceeds to step S1312. In step S1312, the CPU 205 controls the sheet discharge apparatus 134 to perform binding processing on the bundle of sheets on which the printing has been completed, and the processing ends.

The above-described processing for shifting the creasing position for each sheet, as illustrated in FIGS. 7A and 7B, prevents the displacement of a folding position from the creasing position when sheets are folded at the creasing position as illustrated in FIGS. 8A and 8B. While FIGS. 7A and 7B illustrate the products in which the mountain fold is to be made at the creasing position, FIGS. 11A and 11B illustrate the products in which the valley fold is to be made at the creasing position. Also in the case of the valley fold, the displacement of a folding position from the creasing position is prevented as illustrated in FIGS. 12A and 12B.

As described above, even if the binding processing and the creasing processing are performed in different positions, shifting the creasing position for each sheet can decrease the distortion of sheets due to the thickness of the sheets and the displacement of a folding position from the creasing position.

The binding processing for binding a product (a sheet bundle) may be performed by another apparatus which is operated independently of the image forming apparatus main body 101. In this case, however, whether to perform the binding processing needs to be specified in a print job or stored in the ROM 210 or the HDD 211 of the image forming apparatus main body 101.

The first exemplary embodiment has described the control for shifting the creasing position for each sheet included in a product when the creasing processing and the binding processing are to be performed on the product. A second exemplary embodiment includes not only the control according to the first exemplary embodiment, but also control for not shifting the creasing position for each sheet included in a product when the folding processing is to be performed on each sheet. The following describes the second exemplary embodiment.

A flow of processing by the image forming apparatus main body 101 according to the second exemplary embodiment will be described below with reference to FIG. 16.

Figures 16, 16A:
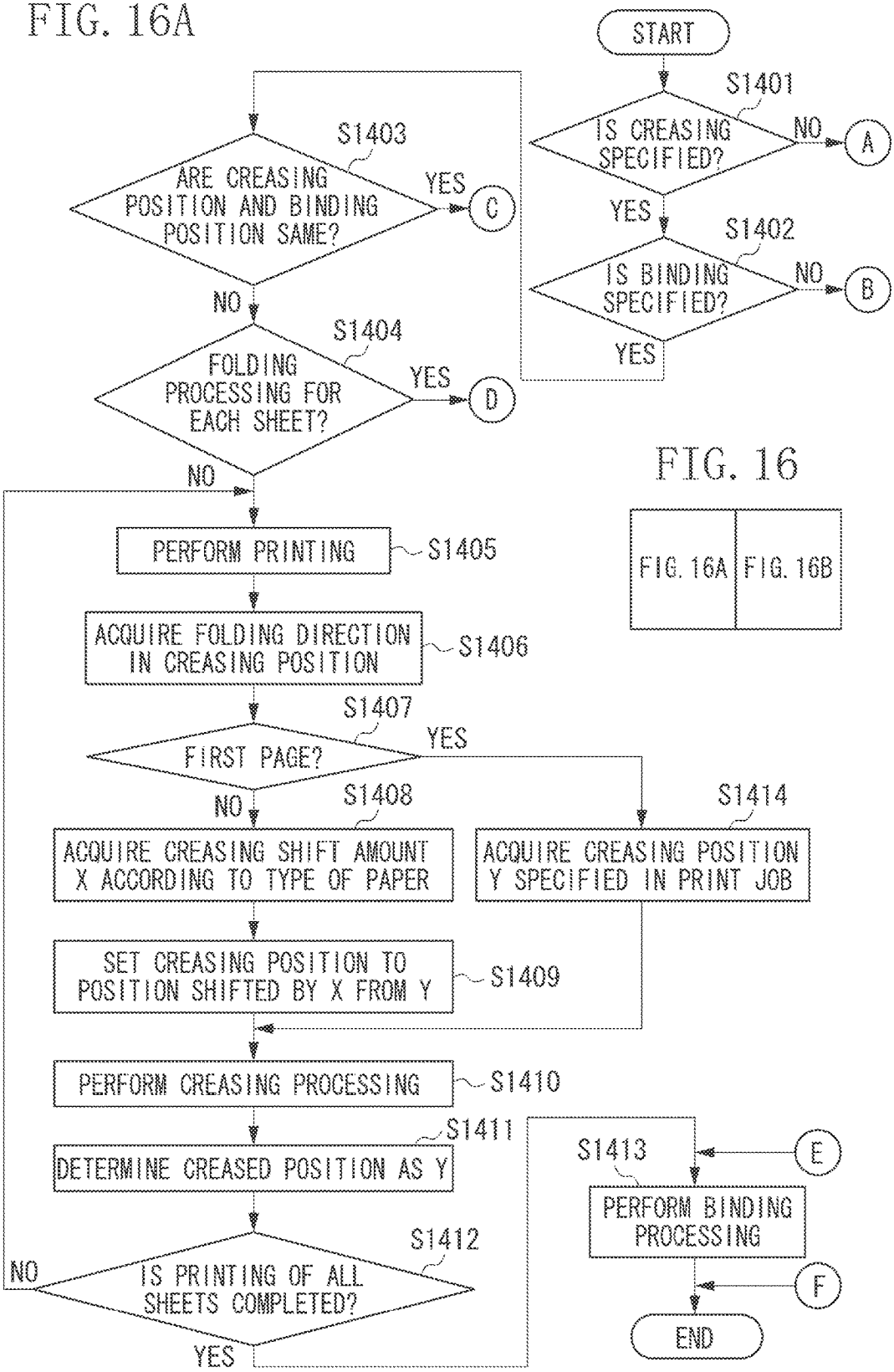
FIG. 16, which consists of FIG. 16A and FIG. 16B, is a flowchart illustrating an example of processing by the image forming apparatus main body according to a second exemplary embodiment.
Figure 16B:
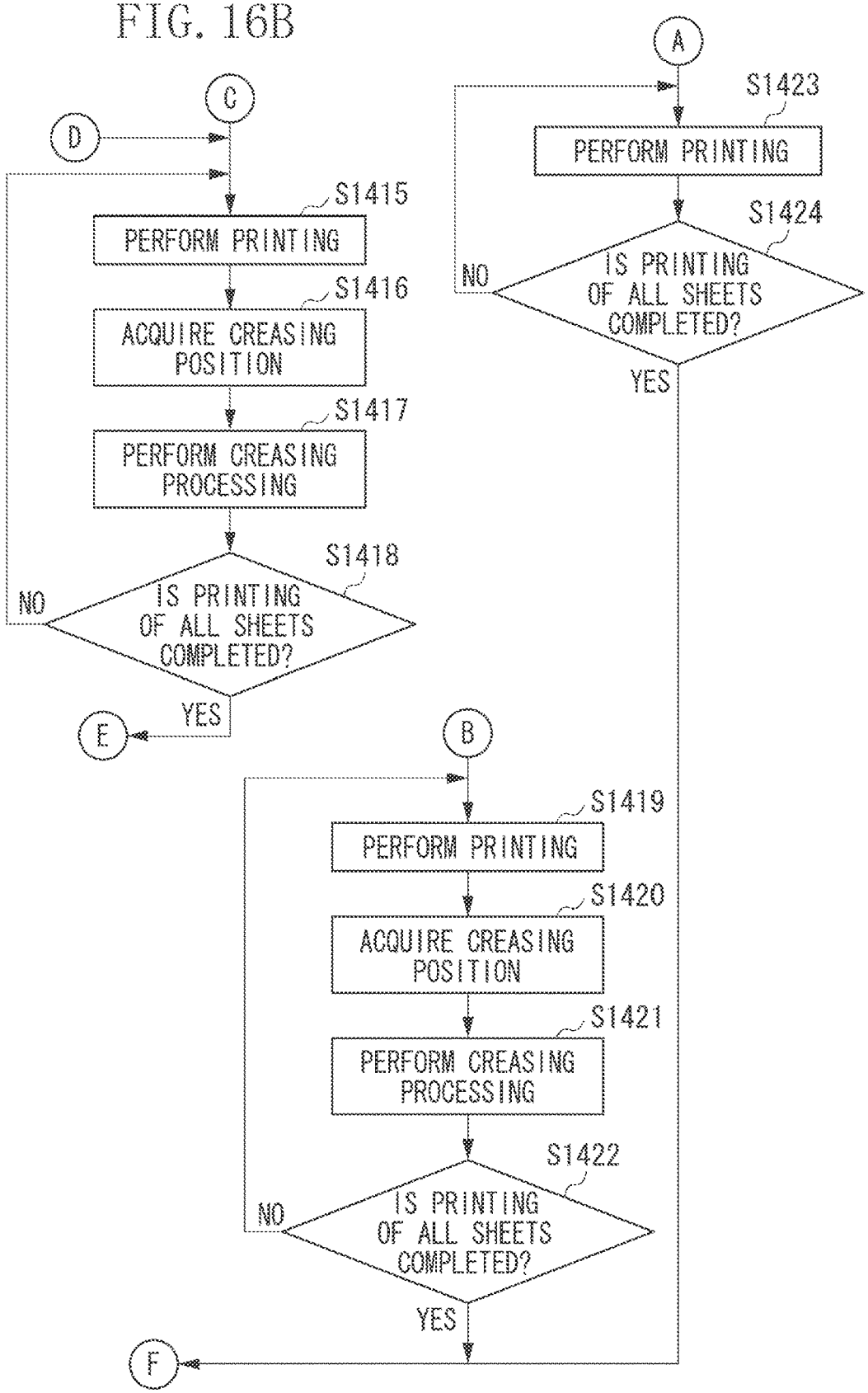

FIG. 16 is a flowchart illustrating an example of the processing by the image forming apparatus main body 101 according to the second exemplary embodiment. The processing of the flowchart is realized by the CPU 205 of the main controller 201 of the image forming apparatus main body 101 executing a program stored in the ROM 210.

The CPU 205 starts the processing of the flowchart at the time of starting the execution of a print job. The processing in steps S1401 to S1403 and steps S1415 to S1424 is similar to the processing in steps S1301 to S1303 and steps S1314 to S1323 in FIG. 13, respectively, and the description thereof will thus be omitted.

Figure 17:
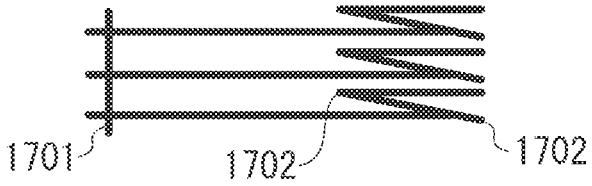
FIG. 17 illustrates an example of a product in which folding processing is performed on a sheet-by-sheet basis.

In step S1403, if the CPU 205 determines that a creasing position and a binding position are not the same (NO in step S1403), the processing proceeds to step S1404. In step S1404, the CPU 205 determines whether the folding processing on a sheet-by-sheet basis is specified in the print job. Whether the folding processing is to be performed on a sheet-by-sheet basis may be specified in the print job, or a value for specifying whether to perform the folding processing on a sheet-by-sheet basis may be stored in the ROM 210 or the HDD 211 of the image forming apparatus main body 101. FIG. 17 illustrates an example of a product on which the folding processing is performed on a sheet-by-sheet basis.

FIG. 17 illustrates an example of a product on which the folding processing is performed on a sheet-by-sheet basis.

As illustrated in FIG. 17, in a case where the folding processing is performed on a sheet-by-sheet basis (each sheet included in a product) and the binding processing is performed at a binding position 1701, folding positions 1702 are the same on all sheets and the displacement thereof does not occur due to the thickness of the sheets. Thus, in a case where the folding processing is performed on a sheet-by-sheet basis, the creasing position must not be shifted.

In the example illustrated in FIG. 17, the same folding processing is performed on the entire product. Even if the folding type and the sheet size varies among the sheets, the creasing position must not be shifted for the sheets on which the folding processing is to be performed on a sheet-by-sheet basis. Whether to perform the folding processing on a sheet-by-sheet basis can be determined based on the contents of a print job in a case where the image forming apparatus performs the folding processing (including the case where the sheet discharge apparatus 134 which can be controlled by the image forming apparatus main body 101 performs the folding processing). On the other hand, in a case where the folding processing is not performed by the image forming apparatus, whether to perform the folding processing on a sheet-by-sheet basis can be guessed based on the creasing position, for example, in a case where sheets are not to be superimposed on the binding position even if the sheets are folded at the creasing position. However, control may be performed to specify whether to perform the folding processing on a sheet-by-sheet basis in a print job, for example.

The description of the flowchart illustrated in FIG. 16 will be made again.

In step S1404, if the CPU 205 determines that the folding processing is performed on a sheet-by-sheet basis (YES in step S1404), that is, if the folding processing is to be performed as illustrated in FIG. 17, for example, the processing proceeds to step S1415.

If the CPU 205 determines that the folding processing is not to be performed on a sheet-by-sheet basis (NO in step S1404), the processing proceeds to step S1405. The processing in steps S1405 to S1413 is similar to the processing in steps S1304 to S1312 illustrated in FIG. 13, and the description thereof will thus be omitted.

As described above, if the folding processing is performed on each sheet in addition to the effect of the first exemplary embodiment, the creasing position is not shifted for each sheet included in a product, so that the creasing position can be prevented from being shifted without user's intention.

The first exemplary embodiment has described the control for shifting the creasing position for each sheet included in a product when the creasing processing and the binding processing are to be performed on the product. In a third exemplary embodiment, a warning is issued according to the folding direction and the binding position when the creasing processing and the binding processing are to be performed on the product, so that the continuation of the processing is controlled by the selection of the user. The following describes the third exemplary embodiment.

A flow of processing by the image forming apparatus main body 101 according to the third exemplary embodiment will be described below with reference to FIG. 18.

Figure 18:
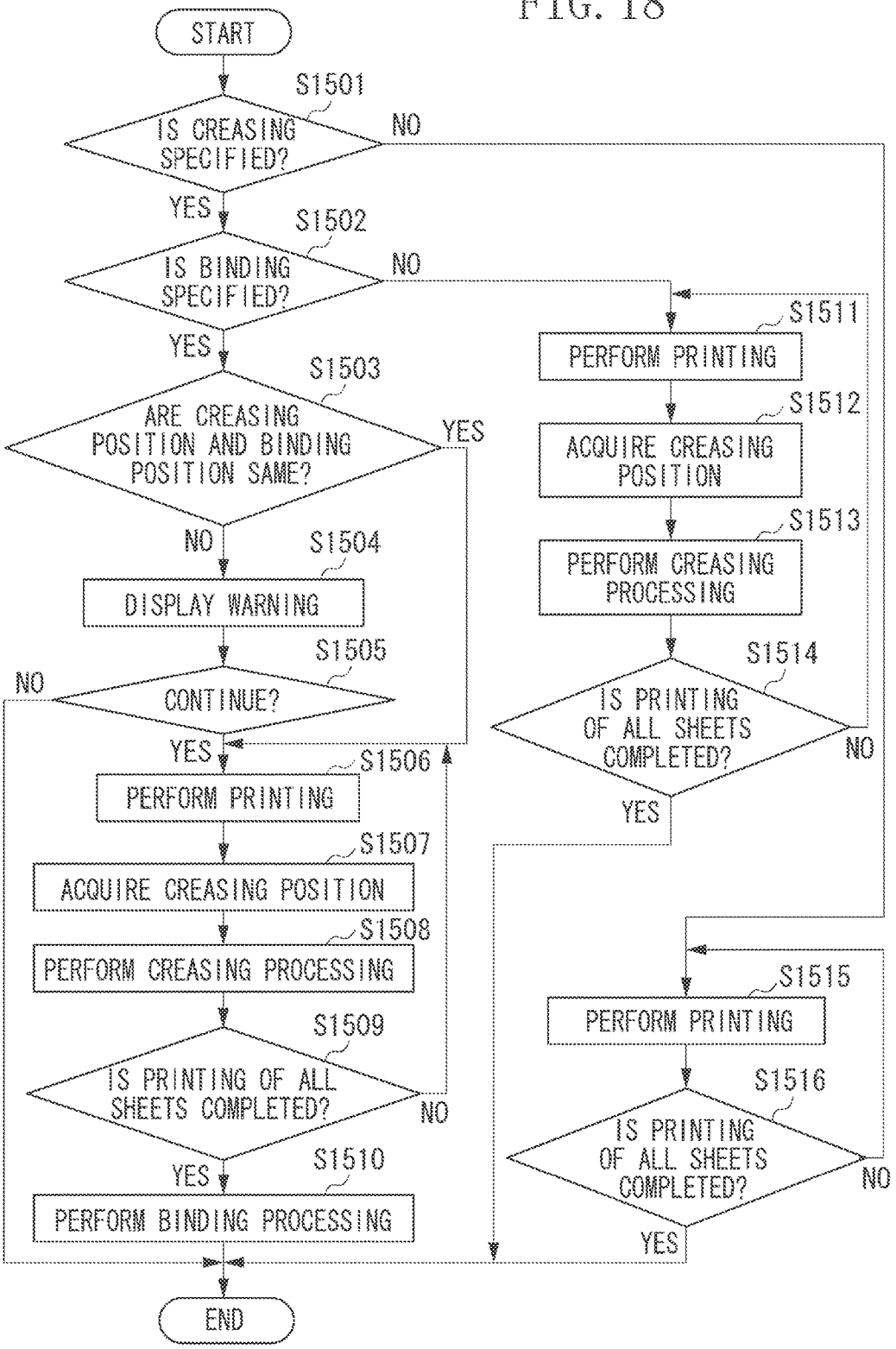
FIG. 18 is a flowchart illustrating an example of processing by the image forming apparatus main body according to a third exemplary embodiment.

FIG. 18 is a flowchart illustrating an example of the processing by the image forming apparatus main body 101 according to the third exemplary embodiment. The processing of the flowchart is realized by the CPU 205 of the main controller 201 of the image forming apparatus main body 101 executing a program stored in the ROM 210.

The CPU 205 starts the processing of the flowchart at the time of starting a print job. The processing in steps S1501 to S1503 and steps S1511 to S1516 is similar to the processing in steps S1301 to S1303 and steps S1318 to S1323 illustrated in FIG. 13, respectively and the description thereof will thus be omitted.

Figure 19:
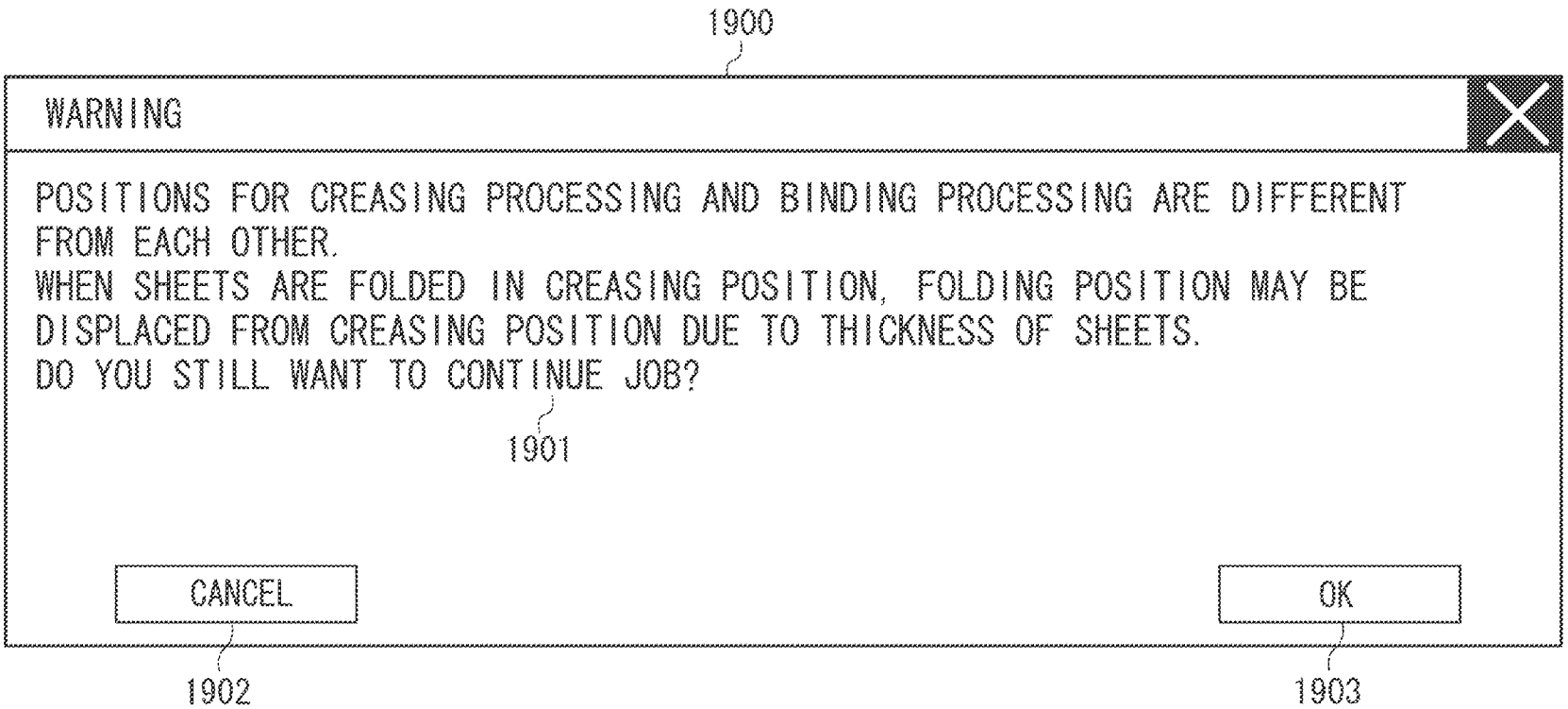
FIG. 19 illustrates an example of a warning screen according to the third exemplary embodiment.

In step S1503, if the CPU 205 determines that the creasing and the binding position are not the same (NO in step S1503), the processing proceeds to step S1504. In step S1504, the CPU 205 controls the operation unit 202 to display a warning. FIG. 19 illustrates an example of the warning.

FIG. 19 illustrates an example of a warning screen according to the third exemplary embodiment.

As illustrated in FIG. 19, a warning message 1901 is displayed on a warning screen 1900 displayed in step S1504. The warning message 1901 indicates that different positions are set for the creasing processing and the binding processing and in this case the folding position may be displaced from the creasing position due to the thickness of sheets when the sheets are folded at the creasing position. The warning screen 1900 further displays a cancel button 1902 and an OK button 1903 to allow the user to select whether to end or continue the print job in response to receiving the warning message 1901. Pressing the cancel button 1902 cancels the print job. Pressing the OK button 1903 continues the execution of the print job.

The description of the flowchart illustrated in FIG. 18 will be made again.

Pressing the cancel button 1902 or the OK button 1903 on the warning screen 1900 displayed in step S1504 causes the processing to proceed to step S1505.

In step S1505, the CPU 205 determines whether to continue the job. If the CPU 205 determines that the cancel button 1902 is pressed on the warning screen 1900, the CPU 205 determines that the processing has been cancelled (NO in step S1505) and the processing ends.

If the CPU 205 determines that the OK button 1903 is pressed on the warning screen 1900, the CPU 205 determines the that the processing is continued (YES in step S1505) and the processing proceeds to step S1506. The processing in steps S1506 to S1510 is similar to the processing in steps S1314 to S1317 illustrated in FIG. 13, and the description thereof will thus be omitted.

As described above, the warning is displayed in a case where the creasing position and the binding position are different from each other, thereby preventing a product which cannot be folded at the creasing position from being generated without the user's intention.

The above exemplary embodiments have described the cases in which the exemplary embodiments are applied to the image forming apparatus. However, the exemplary embodiments may be applied to a sheet processing apparatus. The sheet processing apparatus sets a sheet bundle such as paper therein and performs creasing processing on each sheet of the sheet bundle. The binding processing for binding the sheet bundle may be performed by another apparatus which is operated independently of the sheet processing apparatus. In this case, however, whether to perform the binding processing needs to be specified in a job or set by the sheet processing apparatus to be stored therein.

According to the above exemplary embodiments, control is performed to shift the creasing position little by little for each sheet included in a product so that the creasing position is shifted further on a sheet which is to be located on a more outer side when the product is folded. This control can decrease the distortion of the sheets due to the thickness of the sheets and the displacement of a folding position from the creasing position that are caused when the sheet bundle is subjected to the binding processing and the creasing processing. As a result, even if the product is, for example, a calendar illustrated in FIG. 3, in which the end of a plurality of sheets is bound and which can be used in a folded state, the sheets can be prevented from being distorted when folded.

It is to be understood that the configurations and contents of the above various data are not limited thereto and formed by various configurations and contents according to the application and purpose.

The above-described exemplary embodiments may be achieved as a system, an apparatus, a method, a program, or a storage medium. More specifically, the exemplary embodiments of the present invention may be applied to a system formed of a plurality of devices or an apparatus formed of a single device.

All the configurations in which the above exemplary embodiments are combined are also included in the exemplary embodiments of the present invention.

The exemplary embodiments of the present invention can be executed by the following processing. Software (a program) for realizing the functions of the above-described exemplary embodiments is supplied to a system or an apparatus via a network or various storage media, and a computer (or a CPU or a micro processing unit (MPU)) of the system or the apparatus reads and executes the program.

The exemplary embodiments of the present invention may be applied to a system formed of a plurality of devices or an apparatus formed of a single device.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-044090 filed Mar. 6, 2014, which is hereby incorporated by reference herein in its entirety.

What is claimed is:

1. A sheet processing system comprising:

an image forming unit configured to form images on a plurality of sheets based on a print job;

a creasing device configured to crease the plurality of sheets;

a post processing unit configured to bind the plurality of sheets, wherein the print job includes:

creasing position information about a creasing position on the plurality of sheets to be creased, and binding position information about a binding position on the plurality of sheets to be bound; and a controller configured to control, wherein, in a case where the creasing position information indicates that a center portion of the plurality of sheets is to be creased and the binding position information indicates that an end portion of the plurality of sheets is to be bound, the controller is configured to control creasing positions on the plurality of sheets such that a creasing position, on a sheet that is located more outer side when the plurality of sheets are folded, is to be shifted closer to a side opposite to the binding position than a creasing position on a sheet which is located more inner side when the plurality of sheets are folded.

2. The sheet processing system according to claim 1, wherein the controller is configured to perform control to cause the creasing device to crease a first sheet included in the plurality of sheets, change a position of the plurality of sheets creased by the creasing device by a predetermined amount, and then cause the creasing device to crease a second sheet included in the plurality of sheets.

3. The sheet processing system according to claim 2, wherein the predetermined amount varies depending on a type of a sheet included in the plurality of sheets.

4. A method to control a sheet processing system having an image forming unit, a creasing device, and a post processing unit, the method comprising:

forming, by the image forming unit, images on a plurality of sheets based on a print job;

creasing, by the creasing device, the plurality of sheets;

binding, by the post processing unit, the plurality of sheets, wherein the print job includes:

creasing position information about a creasing position on the plurality of sheets to be creased, and binding position information about a binding position on the plurality of sheets to be bound; and controlling, wherein, in a case where the creasing position information indicates that a center portion of the plurality of sheets is to be creased and the binding position information indicates that an end portion of the plurality of sheets is to be bound, controlling includes controlling creasing positions on the plurality of sheets such that a creasing position, on a sheet that is located more outer side when the plurality of sheets are folded, is to be shifted closer to a side opposite to the binding position than a creasing position on a sheet which is located more inner side when the plurality of sheets are folded.

* * * * *